United States Patent [19]

Taniguchi

[11] 4,103,046

[45] Jul. 25, 1978

[54] METHOD OF IMPREGNATING CARBON ELECTRODES

[75] Inventor: Toru Taniguchi, Kyoto, Japan

[73] Assignees: Nikku Industry Co., Ltd., Itami; Nippon Carbon Co., Ltd., Tokyo, both of Japan

[21] Appl. No.: 742,084

[22] Filed: Nov. 16, 1976

[30] Foreign Application Priority Data

Nov. 29, 1975 [JP] Japan ..... 50-143241

[51] Int. Cl.[2] ..... C25B 11/14

[52] U.S. Cl. ..... 427/113; 427/314; 427/398 B; 427/443; 118/58; 118/69; 118/423; 118/428; 118/500

[58] Field of Search ..... 427/113, 114, 314, 318, 427/189, 195, 45, 46, 443, 185, 424, 317, 374 R, 398 B; 118/55, 308, 324, 239, 70, 58, 69, 423, 428, 500

[56] References Cited

U.S. PATENT DOCUMENTS

| | | | |
|---|---|---|---|
| 979,465 | 12/1910 | Gaston | 427/113 |
| 2,945,471 | 7/1960 | Harrold | 118/58 |
| 3,498,257 | 3/1970 | Grefe et al. | 118/324 X |
| 3,887,729 | 6/1975 | Cavanagh | 118/70 X |
| 4,009,301 | 2/1977 | Heckman et al. | 118/308 X |

*Primary Examiner*—Ralph S. Kendall
*Attorney, Agent, or Firm*—Armstrong, Nikaido, Marmelstein & Kubovcik

[57] ABSTRACT

In a method of impregnating carbon electrodes, a step of heating and drying carbon electrodes is separately juxtaposed to a step of pitch impregnation and cooling so that respective palettes are transported on separate courses for the respective steps, and at a position where said courses approach each other, the electrodes are transferred from a palette for said heating and drying step to a palette for said impregnation and cooling step so that the palette in the step of impregnation and cooling does not pass through a heating and drying furnace in the other step.

1 Claim, 1 Drawing Figure

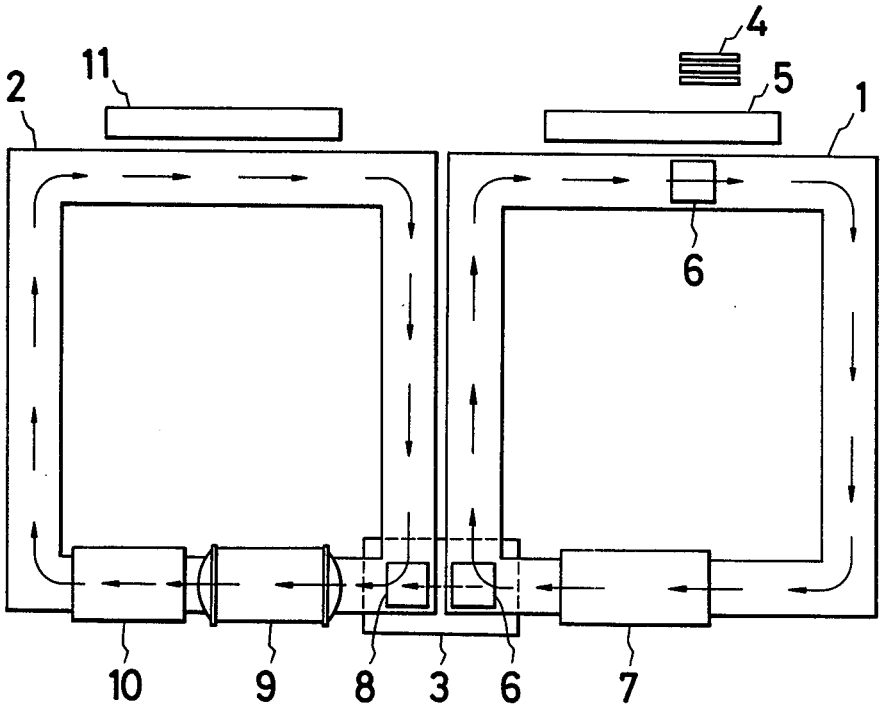
4
5
11
2
1
6
10
9
8
3
6
7

METHOD OF IMPREGNATING CARBON ELECTRODES

BACKGROUND OF THE INVENTION

This invention relates to an improvement in a method of impregnating carbon electrodes with pitch and more particularly to a method of continuously impregnating carbon electrodes with pitch, which enables working circumstances to be maintained in good condition, reduces the danger of fire and keeps transporting means in good condition.

In general, carbon electrodes are produced by a method comprising adding pitch to aggregates including carbon such as coke, etc. as a main part thereof, kneading said mixture, then subjecting said kneaded mixture to press or extrusion working to make formed blocks, burning and sintering the resultant formed blocks at a temperature of 1500° C or so, and thereafter burning the sintered blocks at a temperature between 2,500° and 3,000° C thereby causing graphitization thereof. In a series of these steps, in order to obtain electrodes of higher density and strength, the formed and sintered blanks for electrodes are impregnated with pitch to fill up fine cavities existing in the interior thereof.

Heretofore, as a method of carrying out such impregnating treatment of carbon electrodes with pitch, there has been known a method comprising piling up carbon electrodes on a palette, heating and drying said electrodes on the palette in a drying furnace, thereafter placing them in an impregnation tank to impregnate them with pitch, and after the completion of impregnation, cooling them in a cooling tank. Namely, once the carbon electrodes have once been piled up on a palette, the palette and carbon electrodes are moved as a single body through the series of heating, drying, pitch impregnating and cooling steps, with the result that the palette is also subjected to the same treatment as the carbon electrodes.

As a result, in the prior art treatment, there are difficulties in that in the impregnation step the palette is inevitably coated with pitch and is heated at a high temperature in the drying furnace resulting in melting of the pitch and production of pitch gas, which contaminates the working environment and fires. Additionally, the molten pitch adheres to the transporting device for the palette in the drying furnace and to various parts of said transporting device and causes aggravation of the movement thereof as well as its failure. Also, the pitch attached to the palette is exposed repeatedly to high temperatures, so that it is carbonized and grows in lameller structure, resulting in periodic cleaning of the palette being required. This cleaning operation is fairly troublesome and requires many hands and much time and causes an increase in and interruption of the production steps.

THE INVENTION

It is an object of this invention to avoid the difficulties of the prior art method for impregnating carbon electrodes and particularly, to overcome various problems such as contamination of the working environment, fire and cleaning of palettes, etc. caused by palettes from the impregnation and cooling steps being passed through the drying furnace and subjected to the heating treatment.

In order to accomplish the above object, this invention is characterized in that transporting courses are constructed so that the heating and drying step is separate and independent of the pitch impregnation and cooling step and transshipping, i.e. transfer, between palettes is performed at an approaching portion of both of said courses.

The foregoing and other objects, features and advantages of this invention will be apparent from the following detailed explanation, which proceeds with reference to the accompanying drawing in which:

The FIGURE is a diagrammatic view showing an embodiment of the continuous impregnation step of carbon electrodes according to this invention.

As is apparent from the drawing, an annular heating and drying line 1 is juxtaposed to a pitch impregnation and cooling line 2, and at an approaching, or adjacent, portion of said lines a transshipping apparatus 3 is provided which is adapted to transfer electrodes from one palette to the other.

The numeral 4 designates carbon electrodes which have been treated in a so-called burning step. These electrodes are loaded on a palette 6 at a loading station 5, and carried along the heating and drying line 1, and heated in a heating and drying furnace 7. After leaving said heating and drying furnace 7, the palette 6 arrives at the transshipping apparatus 3, where the electrodes on the palette 6 are transferred to another palette 8 adapted to move along the impregnation and cooling line 2. The empty palette 6 from which the electrodes have been unloaded is forwarded to the loading station 5, and other electrodes 4 are again loaded on said palette 6, and said heating, drying and transshipping processes are repeated.

The carbon electrodes 4 transferred to the palette 8 at the transshipping apparatus 3 are carried into an impregnating tank 9 and after being subjected to the pitch impregnation treatment are cooled in a cooling tank 10.

The electrodes 4 on the palette 8 cooled in the cooling tank 10 are transported to a discharge station 11 and unloaded from the palette 8, and the empty palette 8 is again forwarded to the transshipping apparatus 3, where the carbon electrodes 4 delivered from the heating and drying furnace 7 after completion of the heating and drying thereof are again transferred from the palette 6 to the palette 8. Thereafter the impregnation and cooling treatments are repeated as described above.

The feature of this invention lies in that the heating and drying step (heating and drying line 1) and the impregnaton and cooling step (impregnation and cooling line 2) are separated from each other and connect with each other at the transshipping apparatus 3.

Accordingly, the palette 8 passing through the impregnating tank travels along only the impregnation and cooling line 2, and, therefore, is never heated in the heating and drying furnace as in the prior art. As a result, palette 8 is prevented from becoming wetted with the pitch and is prevented from burning and smoking. Also, the palette 6 on the heating and drying line 1 does not pass through the impregnating tank 9, and, therefore, is not wetted with the pitch. Accordingly, even if said palette 6 is heated at a high temperature in the heating and drying furnace 7 together with the electrodes 4, it does not burn and does not emit pitch gas as in the prior art.

According to the present invention, as described above, since the courses of both of the steps are independent and the palette wetted with pitch does not pass through the heating and drying furnace, the pitch is prevented from being burned and from generating pitch gas, and danger of fire is removed.

Furthermore, according to the present invention, since the heating and drying line and the impregnation and cooling line are juxtaposed with each other to form separate circulating courses, the movement of the palettes becomes easy and the transportation of the electrodes can be carried out smoothly. Also, even if a problem occurs in one of the lines, it is possible to continue the operation in the other line, so that there is little need of interruption of the operation.

What is claimed is:

1. A method of impregnating carbon electrodes with pitch comprising the steps of (1) loading pre-sintered and burned electrodes onto a first palette means; (2) passing said electrodes and first palette means along a first palette transporting course; (3) heating and drying said electrodes as they pass along said first palette transporting course; (4) transferring the electrodes from (3) to a second palette means; (5) passing said electrodes and second palette means along a second palette transporting course; (6) impregnating the electrodes with pitch as they pass along said second palette transporting course; (7) quenching the impregnated electrodes to produce pitch-impregnated electrodes, and (8) unloading said pitch-impregnated electrodes from said second palette means; said first and second palette transporting courses each defining a closed path separate and independent of each other.

* * * * *